United States Patent [19]

Ogata et al.

[11] Patent Number: 4,502,296

[45] Date of Patent: Mar. 5, 1985

[54] CRYOSTAT

[75] Inventors: Hisanao Ogata; Takeo Nemoto; Yoshinori Hakuraku, all of Ibaraki; Yasuomi Yagi, Hitachi, all of Japan

[73] Assignee: Hitachi, Ltd., Tokyo, Japan

[21] Appl. No.: 593,375

[22] Filed: Mar. 26, 1984

[30] Foreign Application Priority Data

Apr. 15, 1983 [JP] Japan ..... 58-65371
Aug. 29, 1983 [JP] Japan ..... 58-156239

[51] Int. Cl.[3] ..... F25B 19/00

[52] U.S. Cl. ..... 62/514 R; 62/45; 174/15 CA

[58] Field of Search ..... 62/514 R, 45; 174/15 CA

[56] References Cited

U.S. PATENT DOCUMENTS

| | | | |
|---|---|---|---|
| 3,133,144 | 5/1964 | Cottingham | 174/15 CA |
| 4,209,657 | 6/1980 | Inai et al. | 62/514 R |
| 4,212,169 | 7/1980 | Kniep, Jr. | 62/514 R |
| 4,218,892 | 8/1980 | Frosch | 62/514 R |
| 4,300,354 | 11/1981 | Buchs et al. | 62/45 |

*Primary Examiner*—Ronald C. Capossela
*Attorney, Agent, or Firm*—Antonelli, Terry & Wands

[57] ABSTRACT

A cryostat including a horizontal hollow space section of room temperature in which a liquid helium vessel is supported by a plurality of support structures each having a multiple cylinder of small thickness and a liquid nitrogen vessel is supported by a plurality of tension rods.

2 Claims, 8 Drawing Figures

CRYOSTAT

BACKGROUND OF THE INVENTION (1) Field of the Invention

This invention relates to a cryostat suitable for use with a superconductive magnet which generates a magnetic field in a hollow space at room temperature.

(2) Description of the Prior Art

Heretofore, cryostats of the type described have in many applications been of a vertical cylinder type, as described in U.S. Pat. No. 4,300,354, for example, which are used in a suspended form by using an upper cover as a pivot. However, when it is necessary to provide a space of room temperature disposed horizontally, as is the case with an application in NMR (Nuclear Magnetic Resonance)—CT (Computed Tomography), the cryostat would have to be of a horizontal cylinder type. A horizontal cylinder type cryostat is disclosed in U.S. Pat. No. 3,133,144, for example. However, no process is known for supporting the liquid helium vessel and liquid nitrogen vessel by a simple construction with a minimized thermal loss.

SUMMARY OF THE INVENTION

This invention has as its object the provision of a cryostat of a horizontal cylinder type which is simple in construction, easy to assemble and low in thermal loss.

To accomplish the aforesaid object, the invention has two outstanding characteristics: one of them is that a plurality of support structures each composed of a multiple cylinder of small thickness are located between a plurality of shaft-like projections extending from end walls of a liquid helium vessel and a plurality of hollow cylindrical portions at opposite ends of a liquid nitrogen vessel corresponding in position to the shaft-like projections while heat insulating plates extend through the support structures, and the other outstanding characteristic is that the hollow cylindrical portions are supported by a plurality of drawbars in a vacuum vessel constituting the outermost layer of the cryostat. When the cryostat is transported, the shaft-like projections may be directly secured to the vacuum vessel by reinforcing members.

DESCRIPTION OF THE PREFERRED EMBODIMENTS

Preferred embodiments of the invention will now be described by referring to the accompanying drawings.

Figure 1:
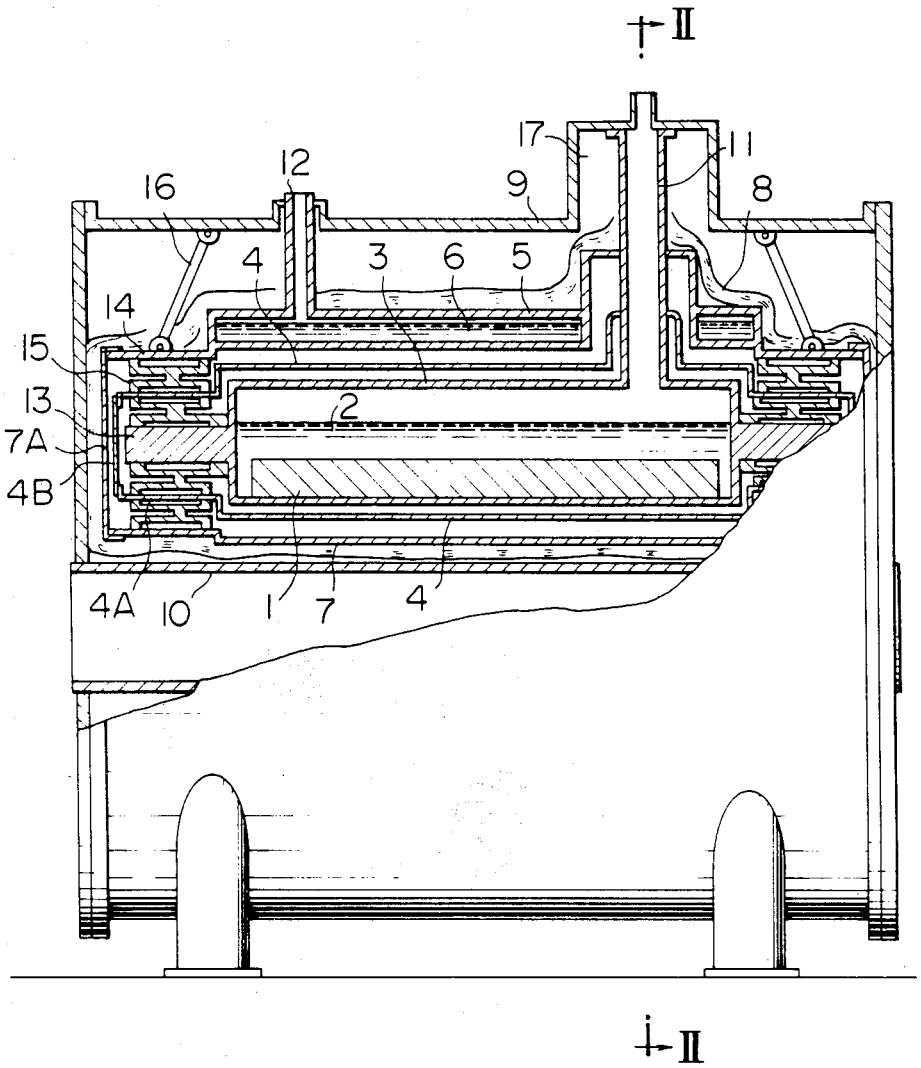
FIG. 1 is a vertical sectional view of the cryostat comprising one embodiment of the invention, taken along the line I—I in FIG. 3.
Figure 2:
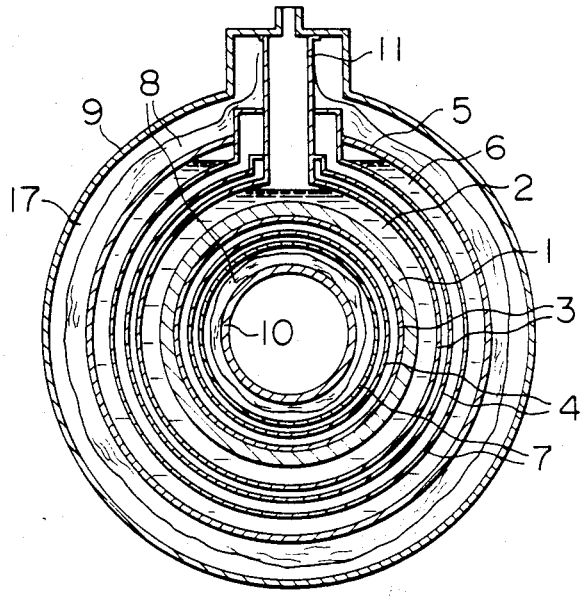
FIG. 2 is a sectional view taken along the line II—II in FIG. 1.

FIGS. 1 and 2 are sectional views of one embodiment of the cryostat having a room temperature space section in conformity with the invention. As shown, a superconductive magnet coil 1 cooled by liquid helium 2 which is a coolant for removing heat from the coil 1 is located in a liquid helium vessel 3 enclosed by first heat insulating plates 4. The numeral 5 designates a liquid nitrogen vessel containing liquid nitrogen 6 and thermally connected to second heat insulating plates 7. The liquid nitrogen vessel 5 has applied to its outer surface a plurality of layers of heat insulating materials 8 including layers of aluminum or a polyester film aluminized on both sides by a vacuum deposition process and layers of poor thermal conductors arranged alternately. The numeral 9 designates a vacuum vessel of room temperature having mounted substantially in its central portion a cylindrical member 10 defining a hollow space section of room temperature. The numeral 11 designates a duct for supplying liquid helium to the liquid helium vessel 3 and passing, in initial stages, an electric current to the superconductive magnet coil 1, and the numeral 12 designates a duct for introducing liquid nitrogen to the liquid nitrogen vessel 5 and withdrawing liquid nitrogen therefrom. The liquid helium vessel 3 is formed at opposite end walls with a plurality of shaft-like projections 13, and the liquid nitrogen vessel 5 is formed at its ends with a plurality of hollow cylindrical portions 14 each having an end wall 7A. The numeral 15 designates a plurality of support structured each including a plurality of cylinders of small thickness connected to each other alternately at opposite ends and in central portions. Heat insulating plates 4A thermally connected to the first heat insulating plates 4 extend through the support structures 15. The cylinders of small thickness are advantageously formed of carbon fiber reinforced resin or glass fiber reinforced resin. The heat insulating plates 4 have a side wall 4B applied to sides thereof. The hollow cylindrical portions 14 are connected to the vacuum vessel 9 by a plurality of rods 16 of low thermal conductivity. The vacuum vessel 9 is evacuated so that its interior has a pressure of below $10^{-5}$ Torr.

Figure 3:
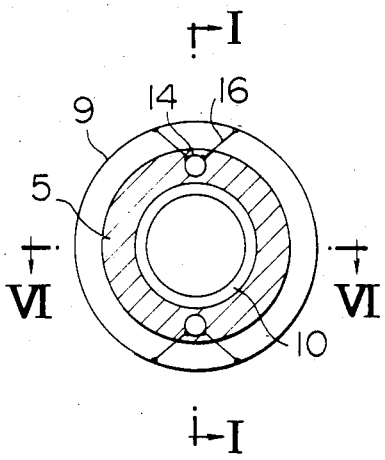
FIGS. 3 and 4 are schematic transverse sectional views of modifications of the embodiment shown in FIG. 1.
Figure 4:
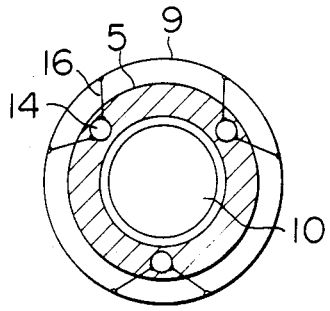

The relation between the rods 16 and hollow cylindrical portions 14 are shown in section in FIGS. 3 and 4. FIG. 3 shows a modification in which the hollow cylindrical portions 14 are four (4) in total, with two each located at one end of the liquid nitrogen vessel 5, and FIG. 4 shows another modification in which the hollow cylindrical portions 14 are six (6) in total, with three each located at one end of the liquid nitrogen vessel 5. The arrangement of the rods 16 may be altered when necessary.

In the cryostat of the aforesaid construction, the liquid helium vessel 3 and first heat insulating plates 4 which are cylindrical in form are only supported at their ends, so that the construction is simple and easy to assemble. Applying the heat insulating material layers 8 to the liquid nitrogen vessel 5 might otherwise be a time-consuming process. However, since all the parts have been assembled in the liquid nitrogen vessel 5 to provide a unitary structure, one only has to wind the heat insulating material layers 8 on the other periphery of the liquid nitrogen vessel 5 and place the unitary structure in the vacuum vessel 9 of a cylindrical shape.

Then, the tension rods 16 are mounted in place while the vacuum vessel remains open at opposite ends, to correctly position the unitary structure and the vacuum vessel 9 relative to each other. Finally, the opposite ends of the vacuum vessel 9 are closed and the cylindrical member 10 is inserted in a central portion of the vacuum vessel 9, thereby finishing assembling the cryostat. A fiber reinforced resin is considerably lower in thermal conductivity than a metal, and each support structure 15 composed of a multiple cylinder of small thickness has a large length because the cylindrical components are folded to increase the heat conducting distance. Moreover, the cylindrical components of the support structure 15 are cooled by the heat insulating plates 4A of 20–50K. Thus, the support structures 15 are rigid enough to bear a load applied thereto while restricting transfer of heat therethrough to the order of several mW. The heat insulating performance of the heat insulating material layers 8 might be reduced if they are penetrated by some elements. However, since the tension rods 16 are small in cross-sectional area, their influences on the heat insulating performance of the heat insulating material layers 8 are minimized.

Figure 5:
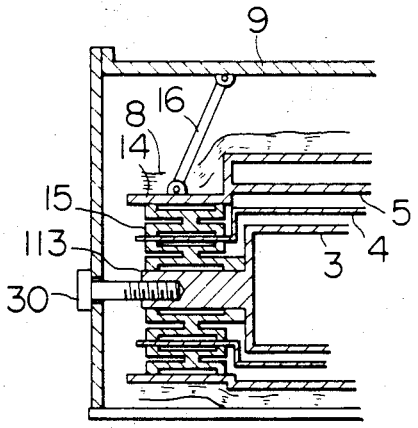
FIG. 5 is a fragmentary sectional view of the cryostat comprising another embodiment.

FIG. 5 shows another embodiment of the invention, of which only a portion of the cryostat in which one of the support structures 15 is located at one end is shown. A cryostat will have to be transported to a site of installation. To keep the heat insulating performance of the cryostat at a high level. The support structures 15 and tension rods 16 are minimized in cross-sectional area, so that their strength is not sufficiently high to withstand a careless handling during transportation. Thus, when the cryostat is transported, end flanges of the vacuum vessel 9 are removed to expose the shaft-like projections 113 which are each formed with a threaded hole, and a reinforcing member 30 is inserted in each threaded hole to firmly secure the shaft-like projections 113 to end plates of the vacuum vessel 9. When transportation is finished, the end plates of the vacuum vessel 9 are removed and the heat insulating plates and heat insulating material layers are restored to their regular positions, before the cryostat is installed in a predetermined position.

As described hereinabove, the cryostat according to the invention can be readily reinforced to avoid any trouble that might otherwise occur during transportation merely by rendering the heat insulating members detachable.

Figure 6:
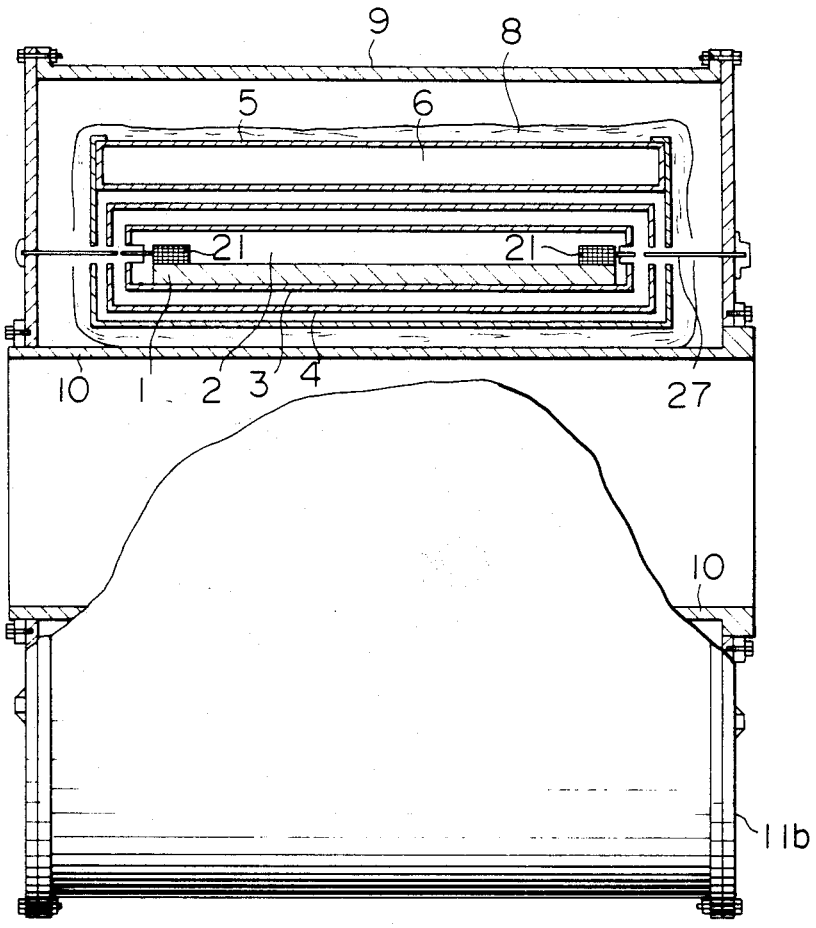
FIG. 6 is a vertical sectional view of the cryostat comprising still another embodiment corresponding to a sectional view taken along the line VI—VI in FIG. 3.

FIG. 6 shows still another embodiment which corresponds to a sectional view taken along the line VI—VI in FIG. 3. Parts shown in FIG. 6 which are similar to those shown in FIGS. 1–4 are designated by like reference characters. The numeral 21 designates auxiliary superconductive magnet coils, and the numeral 27 operating rods for moving the auxiliary superconductive magnet coils 21 either axially or radially to regulate the distribution of magnetic fields formed by the two magnet coils 21 respectively.

Figure 7:
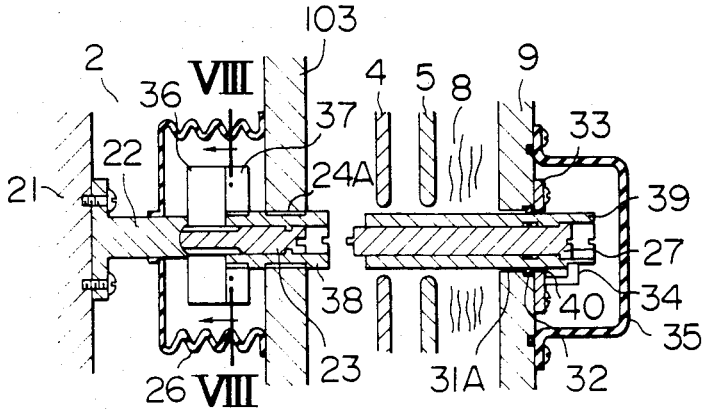
FIG. 7 is a sectional view, on an enlarged scale, of the essential portions of FIG. 6.
Figure 8:
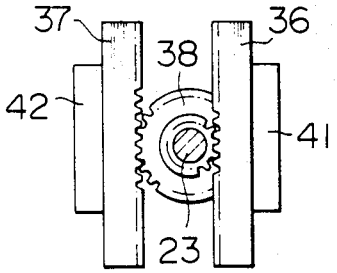
FIG. 8 is a sectional view taken along the line VIII—VIII in FIG. 7.

FIGS. 7 and 8 show in detail an operation mechanism of the auxiliary superconductive magnet coils 21 shown in FIG. 6. As shown, a support member 22 supports a rack 36 with a space arranged perpendicular to the support member 22, an adjusting rod 23 having a worm gear meshing with the rack 36, a rack 37 parallel to the rack 36 and an adjusting rod 38 having a pinion gear meshing with the rack 37, the adjusting rod 38 being concentric with the adjusting rod 23 and prevented from shifting axially. An O-ring 32 and a keep plate 33 therefor provide a seal to the vacuum vessel 9. The adjusting rod 38 is rotatably supported by a wall 103 of very low temperature. Operation rods 27 and 39 for rotating the adjusting rods 23 and 38 respectively are supported coaxially, and a seal ring 40 is inserted in a gap therebetween to provide an airtight seal. As shown in FIG. 7, the racks 36 and 37 are prevented from being brought out of engagement with the respective gears by keep plates 41 and 42, respectively, which are secured to the wall of very low temperature. In this construction, rotation of the internal adjusting rod 23 moves the auxiliary superconductive magnet coil 21 axially (in the same direction as the adjusting rod) and rotation of the external adjusting rod 38 moves the auxiliary superconductive magnet coil 21 radially (in a direction perpendicular to the adjusting rod). Thus, it is possible to effect adjustments of the coil 21 in two directions by performing a single operation, to thereby control the magnetic field distribution. After adjustments have been effected, the operation rod 27 is slightly withdrawn to bring it out of thermal contact with the adjusting rod 23, thereby preventing an input of heat from taking place from the operation rod 27 to the wall 103 of very low temperature.

What is claimed is:

1. A cryostat comprising:

a hollow cylindrical liquid helium vessel containing a superconductive magnet coil and liquid helium;

a plurality of cylindrical heat insulating plates enclosing said hollow cylindrical liquid helium vessel;

a liquid nitrogen vessel located outwardly of one of said plurality of cylindrical heat insulating plates in enclosing relation;

a vacuum vessel enclosing said liquid nitrogen vessel and having a hollow room temperature space section formed substantially in a central portion; and a plurality of rods formed of material of low thermal conductivity for supporting said liquid nitrogen vessel in said vacuum vessel under tension; wherein the improvement resides in that:

said liquid helium vessel extends substantially horizontally and has a plurality of shaft-like projections each extending outwardly from one of opposite end walls thereof;

said liquid nitrogen vessel extends substantially horizontally and has a plurality of hollow cylindrical portions each formed at one of opposite ends thereof in positions corresponding to said shaft-like portions of the liquid helium vessel so that the shaft-like projections and the hollow cylindrical portions are located concentrically with each other; and a plurality of support structures each composed of a multiple cylinder of small thickness formed of material of low thermal conductivity connecting said shaft-like projections to said hollow cylindrical portions, said multiple cylinder including a plurality of cylinders connected to each other alternately at opposite ends and in central portions.

2. A cryostat as claimed in claim 1, wherein each said heat insulating plate has opposite end portions each having a cylindrical portion extending substantially horizontally along one of said shaft-like portions and an end wall portion enclosing an end of each said shaft-like projection, and the cylinders of small thickness of each said support structure are located between said cylindrical portion of one of said heat insulating plates and each said shaft portion of the liquid helium vessel and between said cylindrical portion of the other heat insulating plate and each said hollow cylindrical portion of the liquid nitrogen vessel.

* * * * *